US009094751B2

(12) United States Patent
Chen et al.

(10) Patent No.: US 9,094,751 B2
(45) Date of Patent: Jul. 28, 2015

(54) HEADPHONE APPARATUS AND AUDIO DRIVING APPARATUS THEREOF

(71) Applicant: ISSC Technologies Corp., Hsinchu (TW)

(72) Inventors: Yi-Lung Chen, Hsinshu (TW); Dar-Cherng Su, Hsinchu County (TW)

(73) Assignee: MICROCHIP TECHNOLOGY GERMANY GMBH, Gilching (DE)

( * ) Notice: Subject to any disclaimer, the term of this patent is extended or adjusted under 35 U.S.C. 154(b) by 443 days.

(21) Appl. No.: 13/680,112

(22) Filed: Nov. 19, 2012

(65) Prior Publication Data

US 2014/0140526 A1 May 22, 2014

(51) Int. Cl.

| | |
|---|---|
| ***H04R 1/10*** | (2006.01) |
| ***H04R 5/00*** | (2006.01) |
| ***H04R 5/033*** | (2006.01) |
| ***H04R 5/04*** | (2006.01) |

(52) U.S. Cl.

CPC . *H04R 5/033* (2013.01); *H04R 5/04* (2013.01)

(58) Field of Classification Search

CPC ..... H04R 5/04; H04R 5/033; H04R 1/1041; H03F 3/602

USPC ..... 381/2, 26, 28, 57, 74, 77, 80, 81, 85, 381/95, 96, 111–117, 120, 123, 309, 319, 381/384; 330/3, 10, 69, 124, 251, 252, 297, 330/311; 700/94

See application file for complete search history.

(56) References Cited

U.S. PATENT DOCUMENTS

| | | | | |
|---|---|---|---|---|
| 4,536,716 | A | 8/1985 | Yoshida et al. | |
| 6,950,527 | B2 * | 9/2005 | Chu | 381/74 |
| 7,538,611 | B2 * | 5/2009 | Chen et al. | 330/251 |
| 7,876,911 | B2 * | 1/2011 | Felder et al. | 381/74 |
| 8,736,362 | B2 * | 5/2014 | Huang et al. | 330/10 |
| 2004/0091121 | A1 * | 5/2004 | Morimoto | 381/74 |
| 2007/0222522 | A1 * | 9/2007 | Delano et al. | 330/296 |

* cited by examiner

*Primary Examiner* — Vivian Chin
*Assistant Examiner* — William A Jerez Lora
(74) *Attorney, Agent, or Firm* — Slayden Grubert Beard PLLC

(57) ABSTRACT

The present invention provides a headphone apparatus and a headphone driving apparatus thereof The headphone driving apparatus includes a first and second driving circuits, a signal transmitting circuit, a first and second reference signal generators. The first driving circuit receives a first audio signal pair and generates a first driving signal. The second driving circuit receives a second audio signal pair and generates a second driving signal. The signal transmitting circuit transmits the first audio signal pairs or the reference signal to the first output end pair. The signal transmitting circuit decides to transmit the second audio signal pairs to the second output end pair or not according to the mode selecting signal. The second reference signal generator receives signals and generates the second reference signal. Wherein, the first and second reference signal generators are turned off according to the mode selecting signal.

20 Claims, 4 Drawing Sheets

HEADPHONE APPARATUS AND AUDIO DRIVING APPARATUS THEREOF

BACKGROUND OF THE INVENTION

1. Field of Invention

The present invention generally relates to a headphone driving apparatus, and more particularly to the audio driving apparatus for driving a headphone apparatus with different configurations.

2. Description of Prior Art

In a traditional implementation of a headphone driving apparatus, the dedicated hardware (means integrated circuits, ICs) can only provide one single solution for one audio application use. For different applications, the prior art headphone driving apparatus needs different hardware (different ICs) to support the different applications. That is, in the prior art, the cost of the headphone driving apparatus is increased if the headphone driving apparatus is used to driving a headphone apparatus with multiple configurations. On the other hand, for developing sever solution for the different configurations of the headphone apparatus, it would cost a lot and waste time, and the cost is increased correspondingly.

SUMMARY OF THE INVENTION

The present invention provides a head phone apparatus and an audio driving apparatus thereof with three configuration output to realize cap, cap-less and bridge tied loaded (BTL) configuration.

The present invention provides an audio driving apparatus. The audio driving apparatus includes a first driving circuit, a second driving circuit, a signal transmitting circuit, a first reference signal generator and a second reference signal generator. The first driving circuit receives a first audio signal pair and generates a first driving signal according to the first audio signal pair. The second driving circuit receives a second audio signal pair and generating a second driving signal according to the second audio signal pair. The signal transmitting circuit has a first output end pair and a second output end pair. The signal transmitting circuit receives the first and second audio signal pairs and a reference signal, the signal transmitting circuit transmits the first audio signal pairs or the reference signal to the first output end pair according to a mode selecting signal. The signal transmitting circuit decides to transmit the second audio signal pairs to the second output end pair or not according to the mode selecting signal. The first reference signal generator is coupled to the first output end pair of the signal transmitting circuit for receiving signals on the first output end pair and generating a first reference signal. The second reference signal generator is coupled to the second output end pair of the signal transmitting circuit for receiving signals on the second output end pair and generating a second reference signal. Wherein, the first and second reference signal generators are turned off according to the mode selecting signal.

The invention further discloses a headphone apparatus. The headphone apparatus includes a headphone driving apparatus, a first and second speakers. The headphone driving apparatus includes a first driving circuit, a second driving circuit, a signal transmitting circuit, a first reference signal generator and a second reference signal generator. The first driving circuit receives a first audio signal pair and generates a first driving signal according to the first audio signal pair. The second driving circuit receives a second audio signal pair and generating a second driving signal according to the second audio signal pair. The signal transmitting circuit has a first output end pair and a second output end pair. The signal transmitting circuit receives the first and second audio signal pairs and a reference signal, the signal transmitting circuit transmits the first audio signal pairs or the reference signal to the first output end pair according to a mode selecting signal. The signal transmitting circuit decides to transmit the second audio signal pairs to the second output end pair or not according to the mode selecting signal. The first reference signal generator is coupled to the first output end pair of the signal transmitting circuit for receiving signals on the first output end pair and generating a first reference signal. The second reference signal generator is coupled to the second output end pair of the signal transmitting circuit for receiving signals on the second output end pair and generating a second reference signal. Wherein, the first and second reference signal generators are turned off according to the mode selecting signal. The first and second speakers are coupled to the first and second driving circuits for receiving the first and second driving signals respectively.

Accordingly, the signal transmitting circuit provided by this invention provides the first reference signal generator and the second reference signal generator different type signals according to a mode selecting signal. That is, the headphone driving apparatus configured in single hardware can drive speakers of headphone apparatus with different configurations. The cost of development and maintenance of the headphone apparatus can be reduced.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
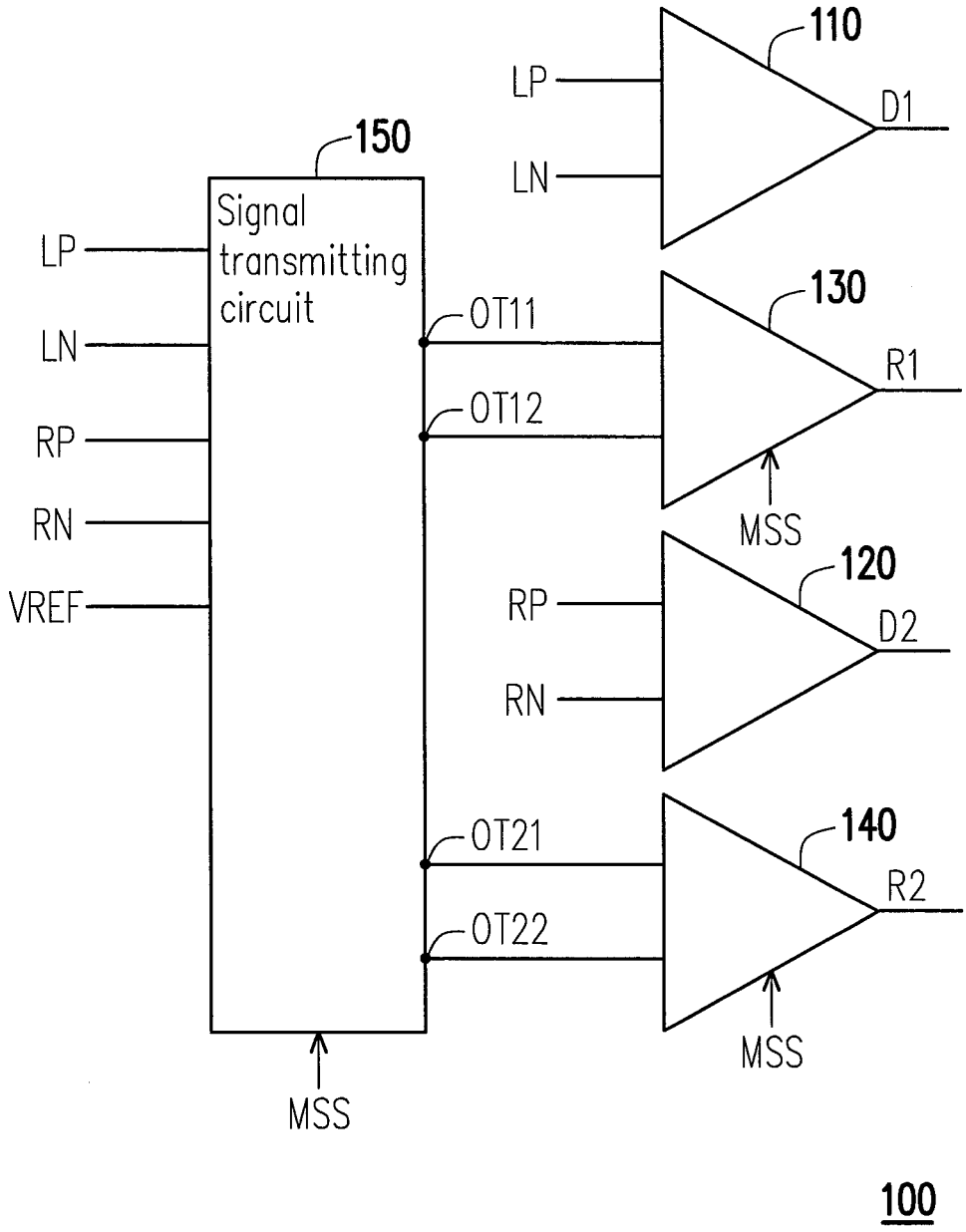
FIG. 1 is a circuit diagram of an audio driving apparatus 100 according to an embodiment of the present invention.

Reference will now be made in detail to the present preferred embodiment of the invention, examples of which are illustrated in the accompanying drawings. Wherever possible, the same reference numbers are used in the drawings and the description to refer to the same or like parts.

Referring to FIG. 1, FIG. 1 is a circuit diagram of an audio driving apparatus 100 according to an embodiment of the present invention. The audio driving apparatus 100 may be used to drive a headphone. The audio driving apparatus 100 includes driving circuits 110 and 120, a signal transmitting circuit 150, and reference signal generators 130 and 140. The driving circuit 110 receives a first audio signal pair which is composed of audio signals LP and LN and generates a first driving signal D1 according to the audio signals LP and LN. The driving circuit 120 receives a second audio signal pair which is composed of audio signals RP and RN and generates a second driving signal D2 according to the audio signals RP and RN.

The signal transmitting circuit 150 has a first output end pair composed of output ends OT11 and OT12 and a second output end pair composed of output ends OT21 and OT22. The signal transmitting circuit 150 receives the first and second audio signal pairs (composed of audio signals LP, LN and RP, RN, respectively) and a reference signal VREF. The signal transmitting circuit 150 transmits the audio signals LP, LN (the first audio signal pair) or the reference signal VREF to the output end OT 11 and OT12 (the first output end pair) according to a mode selecting signal MSS, and the signal transmitting circuit 150 decides to transmit the audio signals RP, RN (the second audio signal pair) to the output end OT21 and OT22 (the second output end pair) or not according to the mode selecting signal MSS.

The first reference signal generator 130 is coupled to the output end OT11 and OT12 for receiving signals on the output ends OT11 and OT12, and the first reference signal generator 130 generates a first reference signal R1 according to the signals on the output ends OT11 and OT12. The second reference signal generator 140 is coupled to the output end OT21 and OT22 for receiving signals on the output ends OT21 and OT22, and the second reference signal generator 140 generates a first reference signal R2 according to the signals on the output ends OT21 and OT22. Furthermore, the reference signal generators 130 and 140 further receive the mode selecting signal MSS, and the reference signal generators 130 and 140 are turned on or off according to the mode selecting signal MSS.

In the embodiment, the mode selecting signal MSS is used to indicate the audio driving apparatus 100 is working in a cap mode, a cap-less mode or a bridge-tied load (BTL) mode. When the mode selecting signal MSS indicates the audio driving apparatus 100 is working in the cap mode, the reference signal generators 130 and 140 are turned off (turned to non-operation) according to the mode selecting signal MSS for saving power consumption. The signal transmitting circuit 150 may stop to provide voltages to the output ends OT11, OT12, OT21 and OT22, and the output ends OT11, OT12, OT21 and OT22 are in high impendence status.

When the mode selecting signal MSS indicates the audio driving apparatus 100 is working in the cap-less mode, the signal transmitting circuit 150 transmits the reference signal VREF to both of the output ends OT11 and OT12, and the second reference signal generator 140 is turned off according to the mode selecting signal MSS. The first reference signal generator 130 generates the reference signal R1 for driving a speaker of a headphone apparatus according to the reference signal VREF on the output ends OT11 and OT12. The output ends OT21 and OT22 are in high impendence status.

When the mode selecting signal MSS indicates the audio driving apparatus 100 is working in the BTL mode, the signal transmitting circuit 150 respectively transmits the audio signals LP, LN to the output ends OT12 and OT11, and respectively transmits the audio signals RP, RN to the output ends OT22 and OT21. Accordingly, the first reference signal generator 130 generates the reference signal R1 for driving one speaker of a headphone apparatus according to the audio signals LP and LN on the output ends OT12 and OT11, and the second reference signal generator 140 generates the reference signal R2 for driving another speaker of the headphone apparatus according to the audio signals RP and RN on the output ends OT22 and OT21.

Please notice here, when the mode selecting signal MSS indicates the audio driving apparatus 100 is working in the BTL mode, the driving signal D1 and the reference signal R1 are differential, and the driving signal D2 and the reference signal R2 are differential.

Figure 2:
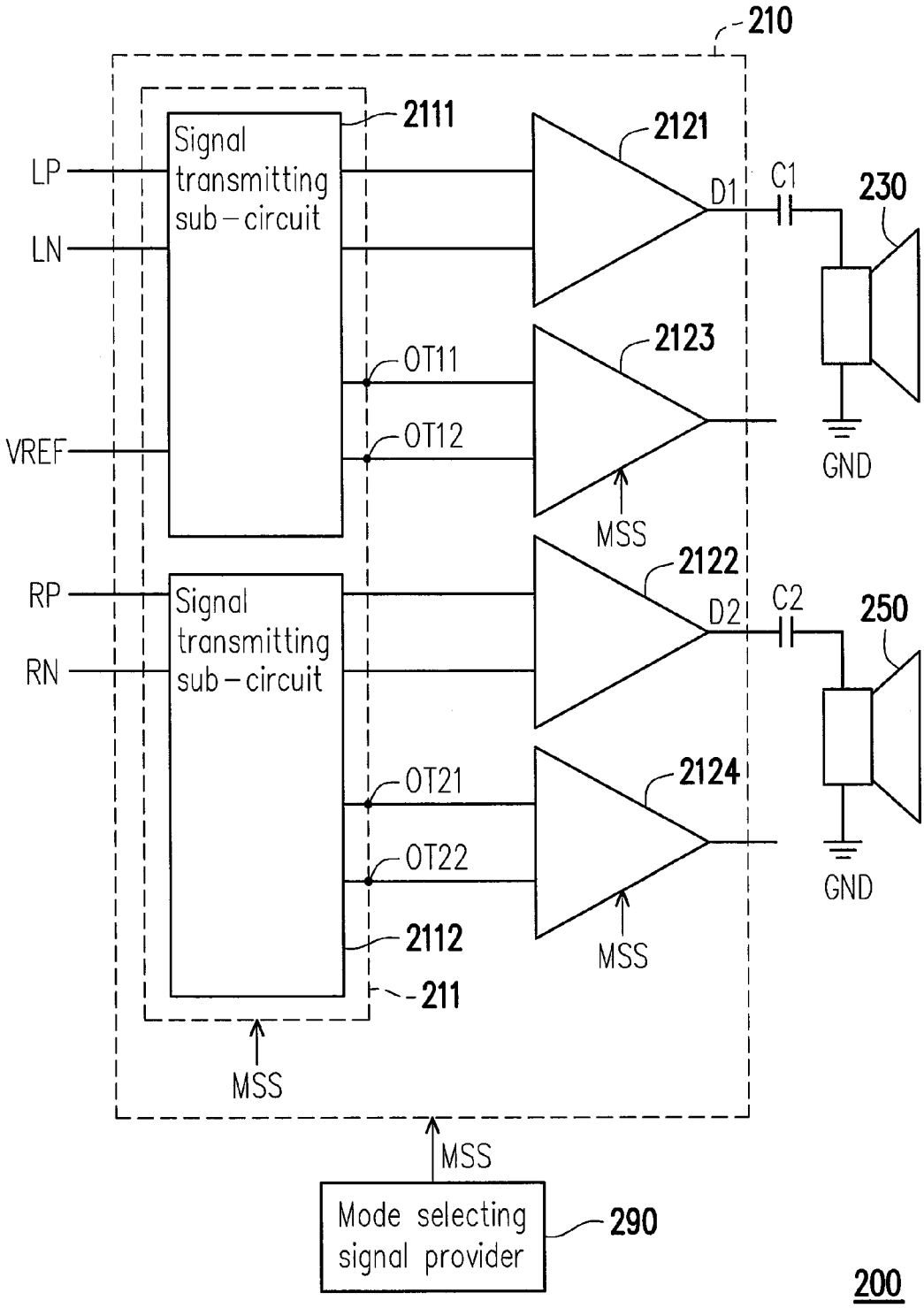
FIG. 2 is a circuit diagram of a headphone apparatus 200 according to an embodiment of the present invention.

Referring to FIG. 2, FIG. 2 is a circuit diagram of a headphone apparatus 200 according to an embodiment of the present invention. The headphone apparatus 200 includes a headphone driving apparatus 210, speakers 230 and 250, and capacitors C1 and C2. The headphone driving apparatus 210 includes a signal transmitting circuit 211, driving circuits 2121 and 2122, and reference signal generators 2123 and 2124. The signal transmitting circuit 211 may be composed of signal transmitting sub-circuits 2111 and 2112. The signal transmitting sub-circuits 2111 receives audio signals LP and LN and a reference signal VREF. The signal transmitting sub-circuits 2112 receives audio signals RP and RN. In this embodiment, the headphone apparatus 200 is work in the cap mode. The signal transmitting sub-circuits 2111 transmits the audio signals LP and LN to the driving circuit 2121. The driving circuit 2121 generates a first driving signal D1 according to the audio signals LP and LN, and provides the first driving signal D1 to the capacitor C1. The signal transmitting sub-circuits 2112 transmits the audio signals RP and RN to the driving circuit 2122. The driving circuit 2122 generates a second driving signal D2 according to the audio signals RP and RN, and provides the second driving signal D2 to the capacitor C2. On the other hand, the capacitor C1 is serial coupled between the driving circuit 2121 and the speaker 230. The speaker 230 is also coupled to a reference ground GND. The capacitor C2 is serial coupled between the driving circuit 2122 and the speaker 250. The speaker 250 is also coupled to the reference ground GND.

In FIG. 2, the reference signal generators 2123 and 2124 are turned off according to the mode selecting signal MSS. The output ends OT11, OT12, OT21 and OT22 may be in high impendence status.

The headphone apparatus further includes a mode selecting signal provider 290. The mode selecting signal provider 290 is coupled to the signal transmitting circuit 211 and the reference signal generators 2123 and 2124. The mode selecting signal provider 290 is used to provide the mode selecting signal MSS to the signal transmitting circuit 211 and the reference signal generators 2123 and 2124. In some embodiments, the mode selecting signal provider 290 may be a memory or registers.

The driving circuits 2121 and 2122 and the reference signal generators 2123 and 2124 may be implemented by operation amplifiers. A person skilled in the art knows how to implement the driving circuits 2121 and 2122 and the reference signal generators 2123 and 2124 by the operation amplifiers, the details of the implementations are not described here.

Figure 3:
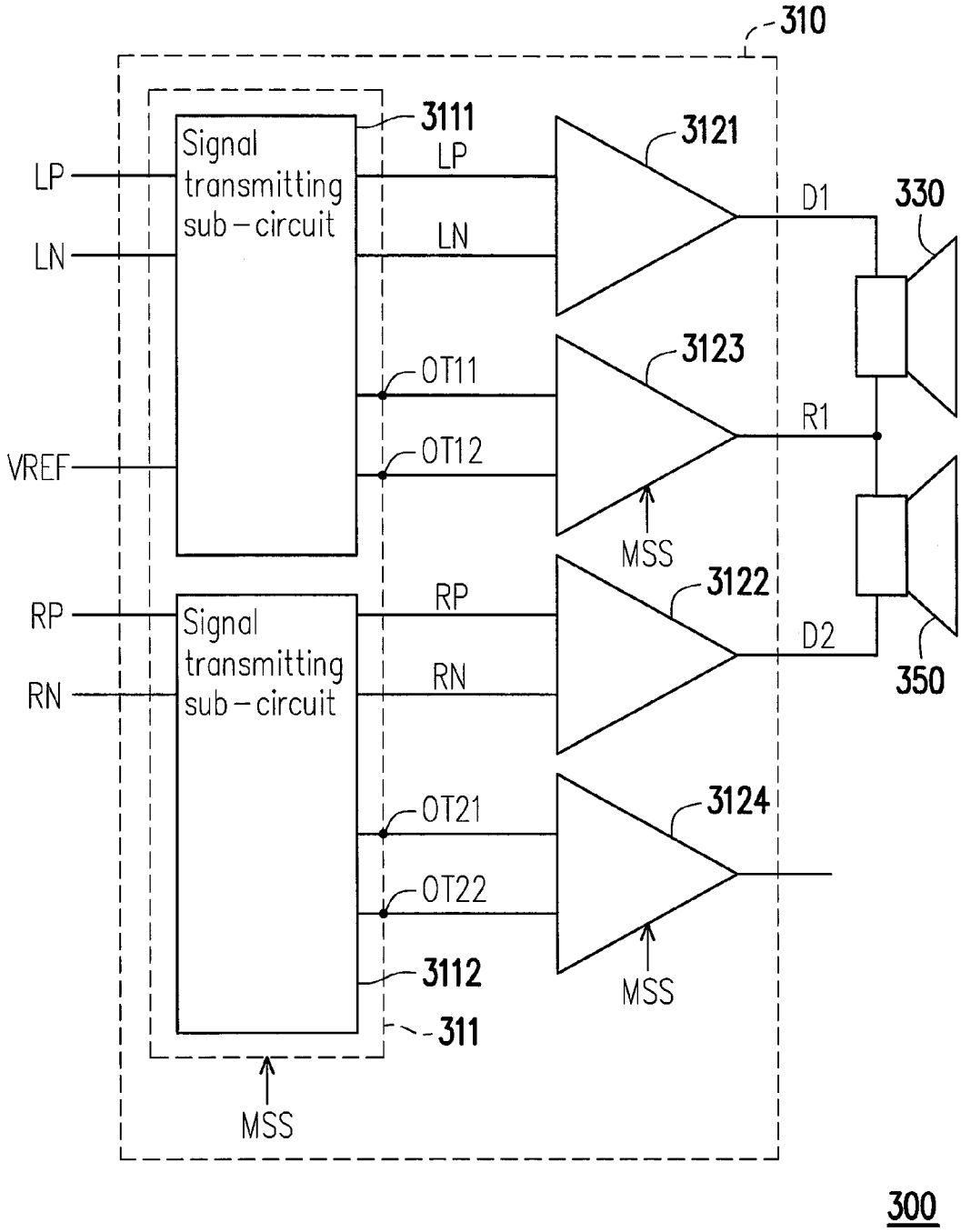
FIG. 3 is a circuit diagram of a headphone apparatus 300 according to another embodiment of the present invention.

Referring to FIG. 3, FIG. 3 is a circuit diagram of a headphone apparatus 300 according to another embodiment of the present invention. The headphone apparatus 300 is working in the cap-less mode. The headphone apparatus 300 includes a headphone driving apparatus 310 and speakers 330 and 350. The headphone driving apparatus 310 includes a signal transmitting circuit 311, driving circuits 3121 and 3122, and reference signal generators 3123 and 3124. The signal transmitting circuit 311 may be composed of signal transmitting sub-circuits 3111 and 3112. The signal transmitting sub-circuits 3111 receives audio signals LP and LN and a reference signal VREF. The signal transmitting sub-circuits 3112 receives audio signals RP and RN.

In this embodiment, the signal transmitting sub-circuits 3111 transmits the audio signals LP and LN to the driving circuit 3121, and the driving circuit 3121 generates a first driving signal D1 to the speaker 330 for driving the speaker 330. Moreover, the signal transmitting sub-circuits 3111 also provides the reference signal VREF to the output ends OT11 and OT12. The reference signal generator 3123 generates the first reference signal R1 for providing to one end which is not coupled to the driving circuit 3121 of the speaker 330. Besides, the first reference signal R1 is also provided to one end which is not coupled to the driving circuit 3122 of the speaker 350. The driving circuit 3122 generates the second driving signal D2 for providing to drive the speaker 350.

On the other hand, the reference circuit 3124 is turned off according to the mode selecting signal MSS for saving power consumption. The output ends OT21 and OT22 may be in high impendence status.

Figure 4:
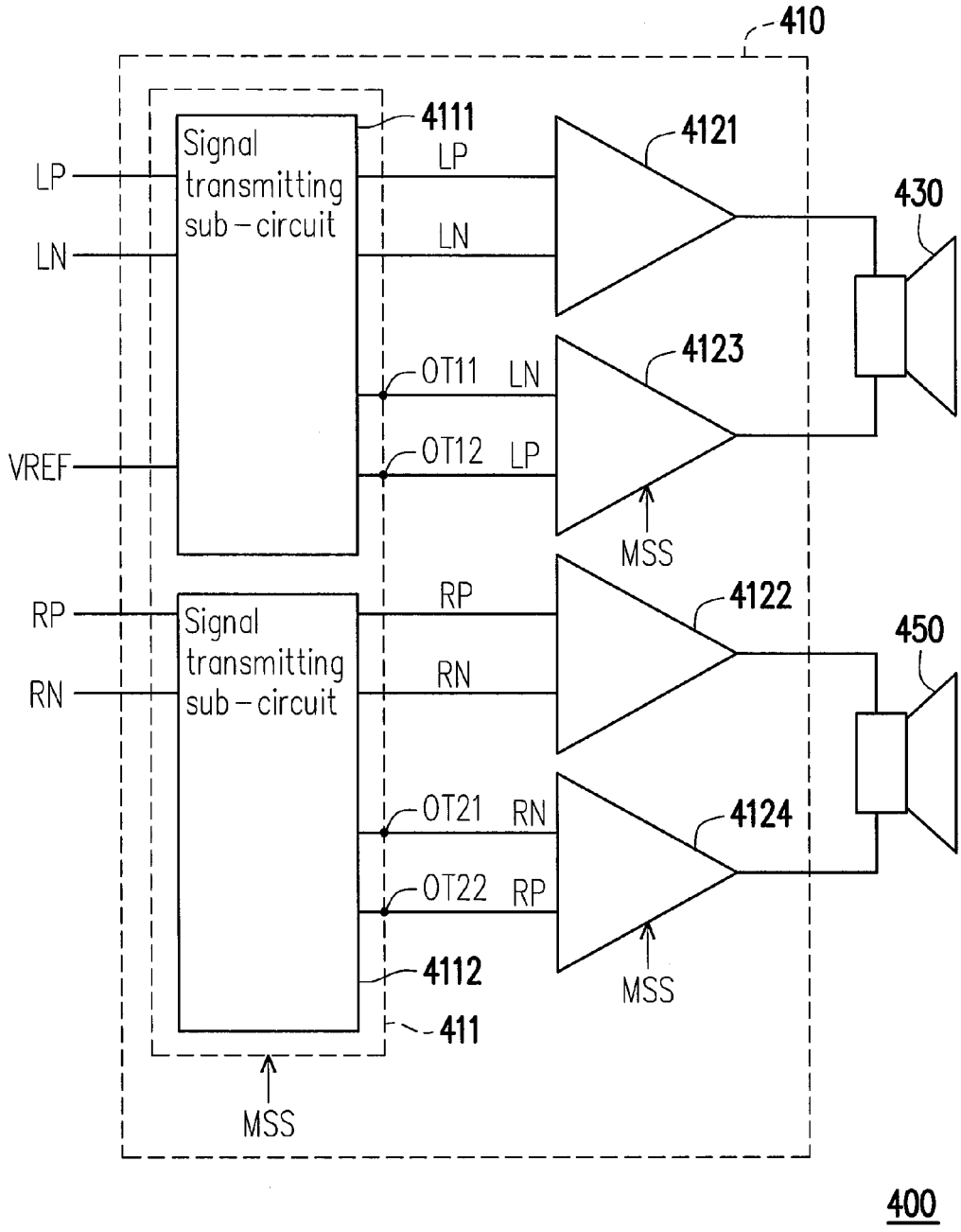
FIG. 4 is a circuit diagram of a headphone apparatus 400 according to the other embodiment of the present invention.

Referring to FIG. 4, FIG. 4 is a circuit diagram of a headphone apparatus 400 according to the other embodiment of the present invention. The headphone apparatus 400 is working in the BTL mode. The headphone apparatus 400 includes a headphone driving apparatus 410 and speakers 430 and 450. The headphone driving apparatus 410 includes a signal transmitting circuit 411, driving circuits 4121 and 4122, and reference signal generators 4123 and 4124. The signal transmitting circuit 411 may be composed of signal transmitting sub-circuits 4111 and 4112. The signal transmitting sub-circuits 4111 receives audio signals LP and LN and a reference signal VREF. The signal transmitting sub-circuits 4112 receives audio signals RP and RN.

In this embodiment, the signal transmitting sub-circuits 4111 transmits the audio signals LP and LN to the driving circuit 4121, and the driving circuit 4121 generates a first driving signal D1 to the speaker 430 for driving the speaker 430. Moreover, the signal transmitting sub-circuits 4111 provides the audio signals LP and LN to the output ends OT12 and OT11, respectively. The reference signal generator 4123 generates the first reference signal R1 for providing to one end which is not coupled to the driving circuit 4121 of the speaker 430. The signal transmitting sub-circuits 4112 transmits the audio signals RP and RN to the driving circuit 4122, and the driving circuit 4122 generates a second driving signal D2 to drive the speaker 450. The signal transmitting sub-circuits 4112 also provides the audio signals RP and RN to the output ends OT22 and OT21, respectively. The reference signal generator 4124 generates the second reference signal R2 for providing to one end which is not coupled to the driving circuit 4122 of the speaker 450.

In this embodiment, the first driving signal D1 and the first reference signal R1 are differential, and the second driving signal D2 and the second reference signal R2 are differential.

In summary, in the invention, the headphone driving apparatus may used to drive speakers with a plurality of configurations. The unused reference signal generators could be turned off for saving power consumption. Accordingly, the development and maintenance cost of the headphone apparatus can be reduced efficiency.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. An audio driving apparatus, comprising:

a first driving circuit, receiving a first audio signal pair and generating a first driving signal according to the first audio signal pair;

a second driving circuit, receiving a second audio signal pair and generating a second driving signal according to the second audio signal pair;

a signal transmitting circuit, having a first output end pair and a second output end pair, the signal transmitting circuit receiving the first and second audio signal pairs and a reference signal, the signal transmitting circuit transmitting the first audio signal pair or the reference signal to the first output end pair according to a mode selecting signal, and the signal transmitting circuit deciding to transmit the second audio signal pairs to the second output end pair or not according to the mode selecting signal;

a first reference signal generator, coupled to the first output end pair of the signal transmitting circuit for receiving signals on the first output end pair and generating a first reference signal; and a second reference signal generator, coupled to the second output end pair of the signal transmitting circuit for receiving signals on the second output end pair and generating a second reference signal, wherein, the first and second reference signal generators are turned off according to the mode selecting signal.

2. The audio driving apparatus according to claim 1, wherein when the mode selecting signal indicates the headphone driving apparatus is working in a cap mode, the first and the second reference signal generators are turned off according to the mode selecting signal.

3. The audio driving apparatus according to claim 2, wherein the first output end pair and the second output end pair are in high impendence status.

4. The audio driving apparatus according to claim 1, wherein when the mode selecting signal indicates the headphone driving apparatus is working in a cap-less mode, the signal transmitting circuit transmits the reference signal to the first output end pair, and the second reference signal generator is turned off according to the mode selecting signal.

5. The audio driving apparatus according to claim 4, the second output end pair is in high impendence status.

6. The audio driving apparatus according to claim 1, wherein when the mode selecting signal indicates the headphone driving apparatus is working in a bridge-tied load (BTL) mode, the signal transmitting circuit transmits the first audio signal pair to the first output end pair, and transmits the second audio signal pair to the second output end pair.

7. The audio driving apparatus according to claim 6, wherein the first driving signal and the first reference signal are differential, the second driving signal and the second reference signal are differential.

8. The audio driving apparatus according to claim 1, further comprising:

a mode selecting signal provider, coupled to the signal transmitting circuit for providing the mode selecting signal to the signal transmitting circuit.

9. The audio driving apparatus according to claim 7, wherein the mode selecting signal provider is a storage device.

10. A headphone apparatus, comprising:

a headphone driving apparatus, comprising:

a first driving circuit, receiving a first audio signal pair and generating a first driving signal according to the first audio signal pair;

a second driving circuit, receiving a second audio signal pair and generating a second driving signal according to the second audio signal pair;

a signal transmitting circuit, having a first output end pair and a second output end pair, the signal transmitting circuit receiving the first and second audio signal pairs and a reference signal, the signal transmitting circuit transmitting the first audio signal pair or the reference signal to the first output end pair according to a mode selecting signal, and the signal transmitting circuit deciding to transmit the second audio signal pairs to the second output end pair or not according to the mode selecting signal;

a first reference signal generator, coupled to the first output end pair of the signal transmitting circuit for receiving signals on the first output end pair and generating a first reference signal; and a second reference signal generator, coupled to the second output end pair of the signal transmitting circuit for receiving signals on the second output end pair and generating a second reference signal, wherein, the first and second reference signal generators are turned off according to the mode selecting signal; and a first and second speakers, coupled to the first and second driving circuits for receiving the first and second driving signals respectively.

11. The headphone apparatus according to claim 10, wherein when the mode selecting signal indicates the headphone driving apparatus is working in a cap mode, the first and the second reference signal generators are turned off according to the mode selecting signal.

12. The headphone apparatus according to claim 11, wherein the first output end pair and the second output end pair are in high impendence status.

13. The headphone apparatus according to claim 11, further comprising:

a first and second capacitors, the first and second capacitors are coupled between the paths respectively for the first and second speakers receiving the first and second driving signals, wherein, ends of the first and second speakers which are not respectively coupled to the first and second capacitors are coupled to a reference ground.

14. The headphone apparatus according to claim 10, wherein when the mode selecting signal indicates the headphone driving apparatus is working in a cap-less mode, the signal transmitting circuit transmits the reference signal to the first output end pair, and the second reference signal generator is turned off according to the mode selecting signal.

15. The headphone driving apparatus according to claim 14, the second output end pair is in high impendence status.

16. The headphone driving apparatus according to claim 14, ends of the first and second speakers which are not respectively coupled to the first and second driving circuit are coupled to the first reference signal generator.

17. The headphone apparatus according to claim 10, wherein when the mode selecting signal indicates the headphone driving apparatus is working in a bridge-tied load (BTL) mode, the signal transmitting circuit transmits the first audio signal pair to the first output end pair, and transmits the second audio signal pair to the second output end pair.

18. The headphone apparatus according to claim 17, ends of the first and second speakers which are not respectively coupled to the first and second driving circuit are coupled to the first and second reference signal generators respectively.

19. The headphone apparatus according to claim 17, wherein the first driving signal and the first reference signal are differential, the second driving signal and the second reference signal are differential.

20. The headphone apparatus according to claim 10, wherein the headphone driving apparatus further comprises:

a mode selecting signal provider, coupled to the signal transmitting circuit for providing the mode selecting signal to the signal transmitting circuit.

* * * * *